US006270073B1

(12) United States Patent
Landwehr

(10) Patent No.: US 6,270,073 B1
(45) Date of Patent: Aug. 7, 2001

(54) STACKING DEVICE

(75) Inventor: Martin Landwehr, Paderborn (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/581,984

(22) PCT Filed: Nov. 16, 1998

(86) PCT No.: PCT/DE98/03351

§ 371 Date: Jun. 20, 2000

§ 102(e) Date: Jun. 20, 2000

(87) PCT Pub. No.: WO99/33736

PCT Pub. Date: Jul. 8, 1999

(30) Foreign Application Priority Data

Dec. 23, 1997 (DE) ..... 197 57 421

(51) Int. Cl.[7] ..... B65G 29/00; B65G 17/32

(52) U.S. Cl. ..... 271/187; 271/315; 148/384; 148/715; 270/39.09; 414/189

(58) Field of Search ..... 271/315, 187; 198/384, 715; 270/39.09; 414/189

(56) References Cited

U.S. PATENT DOCUMENTS 3,409,290 * 11/1968 Bergland ..... 271/69 X
4,768,642 9/1988 Hunter ..... 198/425
4,881,731 * 11/1989 Simpson-Davis ..... 271/315 X
5,163,672 * 11/1992 Mennie ..... 271/187
5,226,641 * 7/1993 Schlieleit ..... 271/187
5,803,705 * 9/1998 Keyes ..... 414/793.9 X
5,899,448 * 5/1999 Hosking ..... 271/3.08 X

FOREIGN PATENT DOCUMENTS 2 119993 11/1983 (GB) .
63-212664 9/1988 (JP) .
97/34263 9/1997 (WO) .

* cited by examiner

*Primary Examiner*—Christopher P. Ellis
*Assistant Examiner*—Kenneth W Bower
(74) *Attorney, Agent, or Firm*—McCormick, Paulding & Huber LLP

(57) ABSTRACT

A stacking apparatus comprising a rotatable stacking wheel with a multiplicity of fingers, of which one end is fastened on the circumference of a hub, enclosing a stacking-wheel spindle and between which there is formed in each case one receiving gap for sheet-like articles, said stacking apparatus being characterized in that the width of the receiving gap can be adjusted between an open position, in which the sheet-like articles can be introduced into the gap, and a position in which the sheet-like articles are retained.

7 Claims, 2 Drawing Sheets

STACKING DEVICE

FIELD OF THE INVENTION

The invention relates to a stacking apparatus according to the preamble of claim 1.

BACKGROUND OF THE INVENTION

Such a stacking apparatus is described in JP 63-212 664 A1.

Stacking apparatuses of the type mentioned are used, inter alia, in automatic cash machines. Their purpose there is to remove from a transporting apparatus banknotes which are drawn off one after the other from banknote containers, and to gather said banknotes together on a stacking surface to give a banknote stack. Such an automatic cash machine is known, for example, from WO 97/34263 A1. In this case, the banknotes are introduced at high speed into a receiving gap between in each case two fingers of a rotating stacking wheel. On account of the unavoidable slippage of the banknote on the transporting apparatus and of the banknote leading edge, which is not always aligned perpendicularly to the transporting direction, there may be a collision between the banknotes and a finger.

The object of the invention is to propose a straightforward apparatus in which the risk of a banknote colliding with the stacking wheel is minimized.

SUMMARY OF THE INVENTION

According to JP 63-212 664 A1, the collision problem is solved in that there is provided a rotatable stacking wheel with a multiplicity of fingers which are fastened on the circumference of a hub, enclosing a stacking-wheel spindle, and between which there is formed in each case one receiving gap for sheet-like articles. The width of the receiving gap is adjusted with the aid of a stationary control plate, in dependence on the angle position of the stacking wheel, between an open position, in which the sheet-like articles can be introduced into the gap, and a position in which the sheet-like articles are retained. Each finger is designed as a first lever arm of a two-armed lever which can be rotated about a pivot spindle aligned parallel to the stacking-wheel spindle, the pivot spindle of the finger passing axially through a bearing journal projecting laterally from the hub. The second lever arm projects into the interior of the hub, where it slides on the circumference of the control plate. The arrangement known from JP 63-212 664 A1 comprises a multiplicity of individual parts which are difficult and time-consuming to assemble.

U.S. Pat. No. 4, 768, 642 A describes a transporting apparatus for a multiplicity of identical articles which are transferred sequentially to the transporting apparatus and discharged in parallel in a predetermined number. This uses an endless transporting belt, a multiplicity of partition walls projecting perpendicularly from the outer circumference thereof. A chamber for receiving in each case one transportation article is produced between adjacent partition walls. At the deflecting rollers for the transporting belt, the chambers open in a funnel-like manner. The articles are fed sequentially at such a location. It is not possible for the transportation articles to be clamped, and thus secured, in the chamber since the width of said chamber, quite obviously, has to be, at most, equal to the distance between the partition walls. The transporting belt is advanced intermittently rather than continuously since it has to be stopped in each case following an advancement corresponding to the predetermined number of articles, in order that a pusher which can be adjusted perpendicularly to the transporting direction of the transporting belt can push the articles down laterally from said belt.

The object is achieved for a stacking apparatus according to the preamble of claim 1 by the defining features of claim 1.

The stacking wheel is produced according to the invention by injection molding from plastic, in particular carbon-fiber-reinforced polyethylene, and is designed as an elastically deformable ring which is circular in the state in which it does not have any external forces acting on it and on the outer circumference of which the fingers are integrally formed.

The width of the receiving gap is adjusted in a particularly straightforward manner by a ring former on which the ring is mounted rotatably. If the ring is relieved of stressing and does not have any external forces acting on it, it is in the shape of a circle. In contrast, the shape of the ring former is not circular. If the ring former is inserted into the ring, the ring assumes a non-round shape. In this case, the fingers of which the fastening end is located in a region in which the ring undergoes curvature which is more pronounced than its circular shape spread apart from one another and the receiving gap located therebetween becomes wider. If the ring is rotated relative to the ring former, with the result that the abovementioned fingers pass from the region of more pronounced curvature into the region in which the curvature is less pronounced than the circular shape, the width of the receiving gap decreases.

In this case, in that region of the stacking-wheel circumference in which the banknotes are transferred from the transporting apparatus to the stacking wheel, the fingers are bent apart from one another to produce a large width for the receiving gap. In contrast, in the position in which the sheet-like articles are retained, the gap width is considerably reduced to the extent where said sheet-like articles are secured between the fingers. If the stacking wheel has rotated into a discharge region, the distance between the fingers is increased again, with the result that the sheet-like articles can easily be stripped from the receiving gap.

According to a preferred refinement of the invention, a toothing, with which a driven gear wheel meshes, is provided on the inner circumference of the ring, at least over part of the width of the inner surface thereof. The region of the fingers and/or receiving gaps thus remains free of drive and control elements with which a banknote could collide.

According to a first embodiment, the ring former is designed as a non-round, preferably oval plate. In this case, the inner surface of the ring slides on the circumferential surface of the plate. The friction between the two may be kept low by suitable material pairings or by the introduction of a ball race.

In an alternative embodiment, the ring former is formed from at least two gear wheels which are fixed in relation to one another and mesh with the toothing of the ring. In a preferred embodiment, the gear wheels are the planet wheels of a planet gear mechanism, of which the drive wheel is arranged axially in relation to the stacking-wheel spindle. If the gear-wheel arrangement or the planet gear mechanism is inserted into the ring, the latter, in turn, assumes a non-round shape.

BRIEF DESCRIPTION OF THE DRAWINGS

Further details can be gathered from the description and drawing of two exemplary embodiments, in which.

DETAILED DESCRIPTION OF THE PREFERRED EMBODIMENTS

Figure 1:
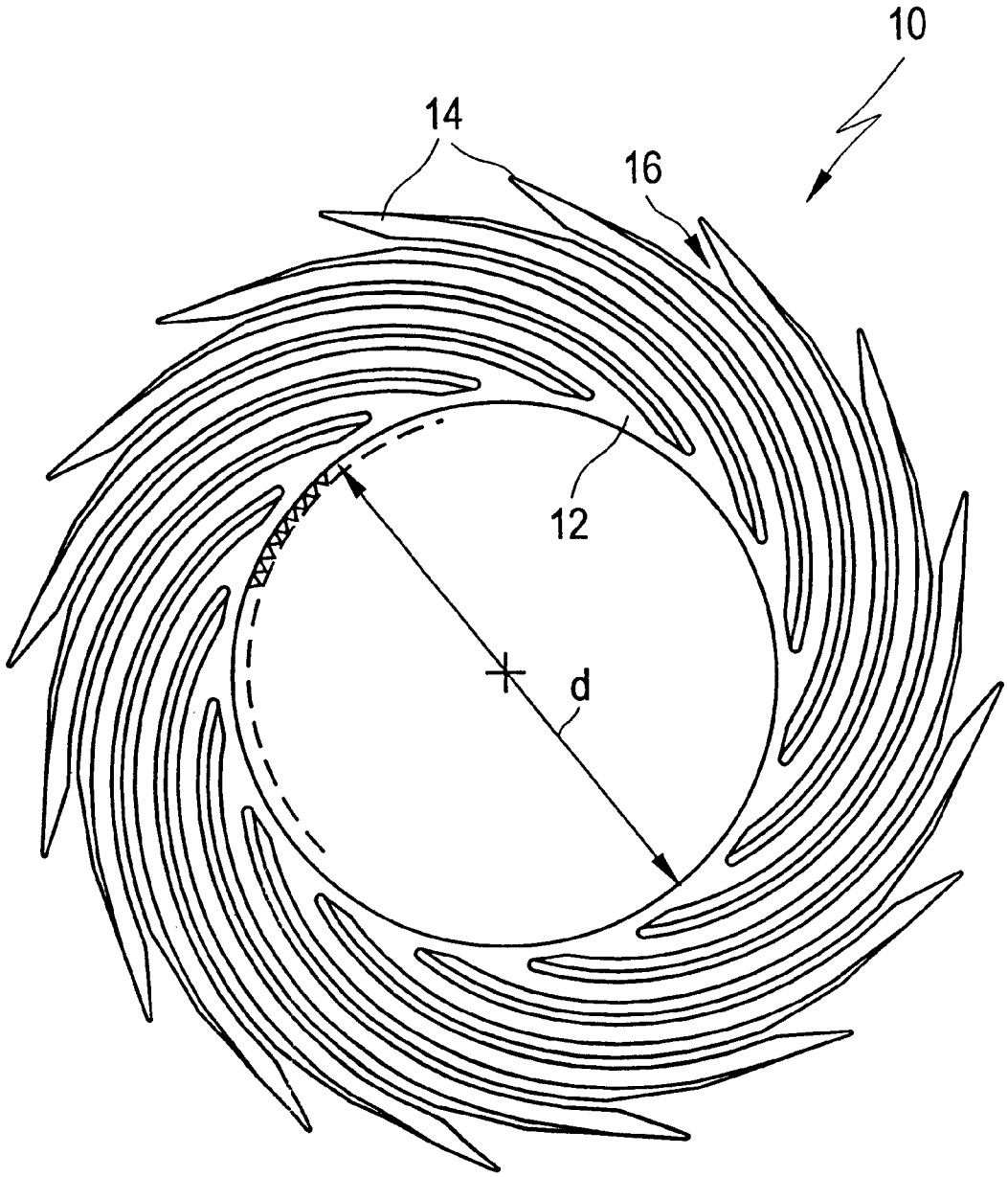
FIG. 1 shows a side view of a stacking wheel.

FIG. 1 illustrates a side view of a stacking wheel 10. Said wheel contains an elastically deformable ring 12 which forms the hub of the stacking wheel 10. Integrally formed in the outer circumference of the ring 12 are a multiplicity of fingers 14, in each case two of these enclosing between them a receiving gap 16 curved in an arcuate manner. The form of the fingers is known per se. In the state in which it does not have any external forces acting on it, the ring 12 is in the shape of a circle with an internal diameter d and therefore an inner circumference U. The inner surface of the ring 12 bears a toothing 18. The stacking wheel 10 is produced in a single piece by injection molding from a fiber-reinforced plastic, preferably from carbon-fiber-reinforced polyethylene.

Figure 2:
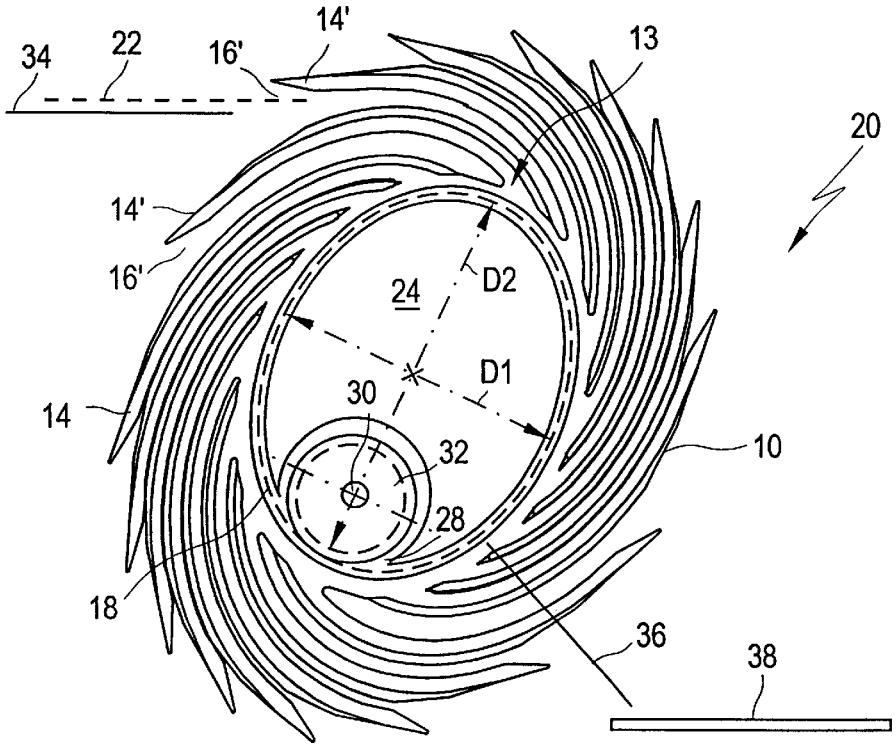
FIG. 2 shows a schematic side view of a first exemplary embodiment of a stacking apparatus.

FIG. 2 illustrates a schematic side view of a first exemplary embodiment 20 of a stacking apparatus for sheet-like articles, in particular banknotes 22. In the stacking apparatus 20, a plurality of the stacking wheels 10 shown in FIG. 1 (only one can be seen) are each mounted on a fixed oval plate 24 such that they can be rotated about a common stacking-wheel spindle 26. The oval plate 24 has a small diameter D1 and a large diameter D2, which is larger than the internal diameter d of the ring 12 which does not have any forces acting on it. Its circumference is slightly smaller than the inner circumference U of the ring 12, with the result that the ring 12 can easily be slid with a small amount of play on the oval plate 24.

The oval plate 24 has a recess 28 which is open in the direction of its circumferential line and in which there is embedded a drive wheel 32 connected in a rotationally fixed manner to a drive shaft 30. Said drive wheel is designed as a gear wheel which meshes with the toothing 18 of the ring 12. If the drive wheel 32 is rotated, the ring 12 runs around the oval plate 24. In this case, the finger 14' of which the fastening end 13 on the ring 12 passes into the region of the large diameter D2 of the oval plate 24 spread from the ring 12, with the result that the receiving gap 16' located therebetween opens in a funnel-like manner. A feed path 34 for banknotes 22 opens out into this region, it thus being possible for said banknotes to pass reliably in the receiving gap 16'.

When the ring 12 rotates in the clockwise direction, the fingers 14 bend back again until, in the region of the small diameter D1 of the oval plate 24, they are located against one another. The receiving gap 16 thus closes and clamps in a banknote 22 deposited therein, in captor fashion, with the result that said banknote cannot slip.

As the ring 12 rotates further, it runs into the bottom region of the large diameter D2, the receiving gap 16 opens again and releases the banknote 22 again. Arranged in this region, laterally alongside the stacking wheel 10, are stripping plates 36 which strip the banknote 22 from the receiving gap 16 in a manner known per se and deposit it on a stacking table 38.

Figure 3:
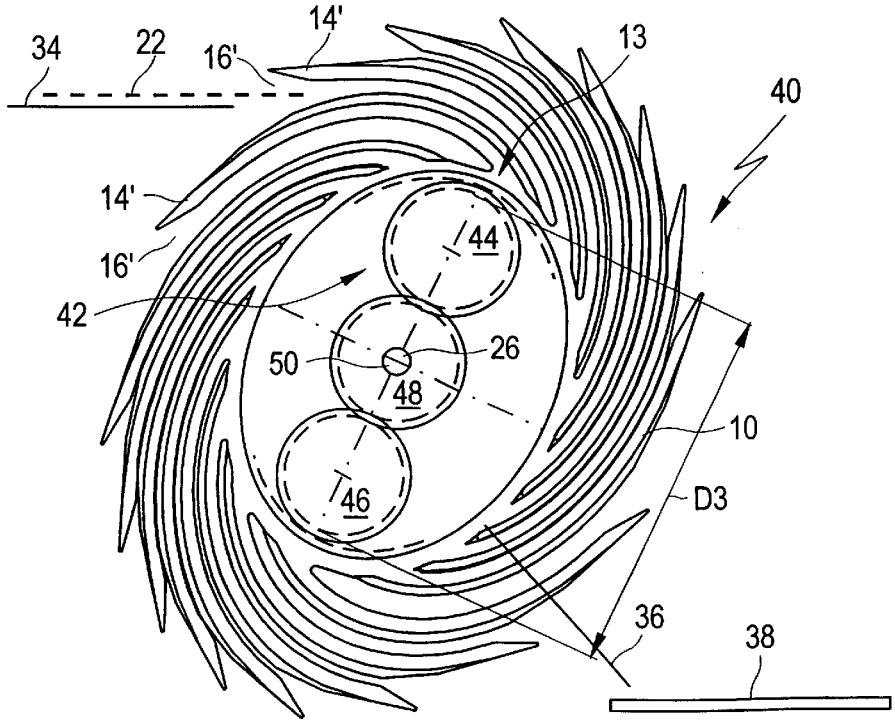
FIG. 3 shows a schematic side view of a second exemplary embodiment of a stacking apparatus.

FIG. 3 illustrates a schematic side view of a second exemplary embodiment 40 of a stacking apparatus for sheet-like articles, in particular banknotes 22. The functioning corresponds to that of the stacking apparatus 20 according to the first exemplary embodiment. The same parts are indicated by the same designations. Instead of the oval plate 24, the ring former used is a planet gear mechanism 42 with two diametrically opposite planet wheels 44, 46 which are designed as gear wheels, of which the circumference rolls on the inner surface of the ring 12 and which mesh with a second drive wheel 48 which is driven in rotation and of which the drive spindle 50 coincides with the stacking-wheel spindle 26. The toothing of the planet wheels 44, 46 engages in the toothing 18 of the ring 12. In this case, the pitch-circle distance D3 of the outer circumferences of the planet wheels 44, 46 corresponds to the large diameter D2 of the oval plate 24 in FIG. 2. A diameter corresponding to the small diameter D1 is given by the inherent rigidity of the ring 12.

If the second drive wheel 48 is rotated, the ring 12 rotates, being driven by the planet wheels 44, 46 about the stacking-wheel spindle 26. In this case, the fingers 14' of which the fastening end 13 on the ring 12 passes into the region of the planet wheels 44, 46 spread from the ring 12, with the result that the receiving gap 16' located therebetween opens in a funnel-like manner. The feed path 34 for banknotes 22 opens out into the region of the top planet wheel 44. Arranged in the region of the bottom planet wheel 46, laterally alongside the stacking wheel 10, are stripping plates 36 which strip the banknote 22 from the receiving gap 16 in a manner known per se and deposit it on the stacking table 38.

It is also possible for the ring former to be configured such that the ring 12 assumes a non-round shape other than an oval. For example, in the first exemplary embodiment according to FIG. 2, the plate could be in the shape of a triangle with rounded corners. In the second exemplary embodiment according to FIG. 3, it would be possible to use more than two planet wheels. It is also possible for the ring former to comprise at least two gear wheels which are fixed in space in relation to one another and of which only one has to be driven in rotation. In all cases, the fingers 14' of which the fastening end 13 on the ring 12 passes into the region of the corners or planet wheels or gear wheels which deflect the ring 12, spread from the ring 12, with the result that the receiving gap 16' located therebetween opens in a funnel-like manner. The ring 12 has to be of a non-round shape other than an oval if the feed path 34 and the stripping plate 36 are arranged with respect to one another at an angle of over 180 ø in relation to the stacking-wheel spindle 26.

What is claimed is:

1. A stacking apparatus (20, 40) comprising a rotatable stacking wheel (10) with a multiplicity of fingers (14), of which one end (13) is fastened on the circumference of a hub (12), enclosing a stacking-wheel spindle (26), and between which there is formed in each case one receiving gap (16, 16') for sheet-like articles (22), it being the case that the width of the receiving gap (16, 16') can be adjusted, in dependence on the angle position of the stacking wheel (10), between an open position, in which the sheet-like articles (22) can be introduced into the gap, and a position in which the sheet-like articles (22) are retained, characterized in that the hub (12) together with the fingers (14) is produced in a single piece by injection molding from plastic, in particular carbon-fiber-reinforced polyethylene, and is designed as an elastically deformable ring (12) which is circular in the state in which it does not have any external forces acting on it, and the ring (12) is mounted rotatably on a ring former (24, 42) which brings the ring (12) into a non-round, in particular oval shape, there being an increase in the size of the receiving gap (16') between fingers (14') of which the fastening end (13) on the ring (12) passes into a region in which the ring (12) assumes a radius of curvature (D2) which is smaller than its circular shape, and a decrease in size of said receiving gap as it leaves said region.

2. The stacking apparatus as claimed in claim 1, characterized in that, at least over part of its width, the inner surface of the ring (12) bears a toothing (18) with which a drive wheel meshes.

3. The stacking apparatus as claimed in claim 1, characterized in that the ring former is a non-round, rounded corner or oval plate (24), and the inner surface of the ring (12) slides with a small amount of play on the circumferential surface of the plate (24).

4. The stacking apparatus as claimed in claim 1, characterized in that the plate (24) has a recess (28) in which the drive wheel (32) is arranged.

5. The stacking apparatus as claimed in claim 3, characterized in that a ball race is introduced between the ring (12) and the plate (24), or a material pairing which keeps the friction low is provided for the ring (12) and the plate (24).

6. The stacking apparatus as claimed in claim 1, characterized in that the ring former comprises at least two gear wheels (44, 46), of which the circumference rolls on the inner surface of the ring (12) and of which at least one is driven in rotation.

7. The stacking apparatus as claimed in claim 6, characterized in that the ring former is a planet gear mechanism (42) with at least two planet wheels (44, 46) which mesh with a second drive wheel (48) which is driven in rotation and of which the spindle coincides with the stacking-wheel spindle (26).

* * * * *